US008256369B2

(12) United States Patent
Karow et al.

(10) Patent No.: US 8,256,369 B2
(45) Date of Patent: Sep. 4, 2012

(54) COLLAPSIBLE CONSTRUCTION BARRIER

(76) Inventors: Mark Karow, Burlington, WI (US); Timothy A. Neal, Genoa City, WI (US)

( * ) Notice: Subject to any disclaimer, the term of this patent is extended or adjusted under 35 U.S.C. 154(b) by 160 days.

(21) Appl. No.: 12/700,496

(22) Filed: Feb. 4, 2010

(65) Prior Publication Data

US 2010/0162942 A1 Jul. 1, 2010

Related U.S. Application Data

(63) Continuation of application No. 11/270,055, filed on Nov. 9, 2005, now Pat. No. 7,690,321, and a continuation-in-part of application No. 10/984,053, filed on Nov. 9, 2004, now abandoned.

(51) Int. Cl.
*E01F 9/012* (2006.01)
*E01F 9/019* (2006.01)

(52) U.S. Cl. ..... 116/63 P; 16/225

(58) Field of Classification Search ..... 116/63 P, 116/63 T, 63 R, 63 C; 40/610, 612; 16/223, 16/224, 225, 227; 49/49; 404/6, 9, 10
See application file for complete search history.

(56) References Cited

U.S. PATENT DOCUMENTS

| | | | | | |
|---|---|---|---|---|---|
| 2,935,238 | A * | 5/1960 | Koehler | 229/116 |
| 4,426,801 | A * | 1/1984 | Gates | 40/610 |
| 4,462,145 | A * | 7/1984 | Schulze | 29/428 |
| 5,030,029 | A * | 7/1991 | Johnsen | 404/6 |
| 5,090,349 | A * | 2/1992 | Wilson | 116/63 C |
| 5,115,343 | A * | 5/1992 | Bennett | 359/529 |
| 5,115,855 | A * | 5/1992 | Lindblom et al. | 160/135 |
| 5,225,254 | A * | 7/1993 | Foulke | 428/12 |
| 5,322,335 | A * | 6/1994 | Niemi | 296/97.23 |
| 5,502,930 | A * | 4/1996 | Burkette et al. | 52/71 |
| 5,631,053 | A * | 5/1997 | Andersen et al. | 428/36.4 |
| 5,851,634 | A * | 12/1998 | Andersen et al. | 428/159 |
| 6,054,194 | A * | 4/2000 | Kane | 428/12 |
| 6,237,895 | B1 * | 5/2001 | Thurston | 256/13.1 |
| 6,394,729 | B2 * | 5/2002 | Welch | 412/3 |
| 6,561,357 | B2 * | 5/2003 | Renck | 206/586 |
| 6,630,094 | B2 * | 10/2003 | Abramson et al. | 264/491 |
| 6,679,654 | B1 * | 1/2004 | Wittenberg et al. | 405/115 |
| 2011/0084516 | A1 * | 4/2011 | Smith et al. | 296/180.4 |

* cited by examiner

*Primary Examiner* — R. A. Smith
(74) *Attorney, Agent, or Firm* — Jansson Shupe & Munger Ltd.

(57) ABSTRACT

A collapsible barrier has at least three integrally-formed wall sections with a plurality of contiguous living hinges, as a series, joining each adjacent pair of wall sections, the at least three wall sections including two endmost wall sections joinable to form an upright structure. A collapsible barrier may include a plurality of interconnected wall sections each having a top-facing side, where one of the top-facing sides has a pocket adapted for securely holding a light. A thermoformed unitary plastic object may include at least two wall sections, at least one hinge member connecting adjacent interior ones of the wall sections' longitudinal sides, the hinge member comprising a plurality of interconnected living hinges, where a nominal thickness of the at least one hinge members of the thermoformed unitary plastic object approximates 0.100 inch.

21 Claims, 14 Drawing Sheets

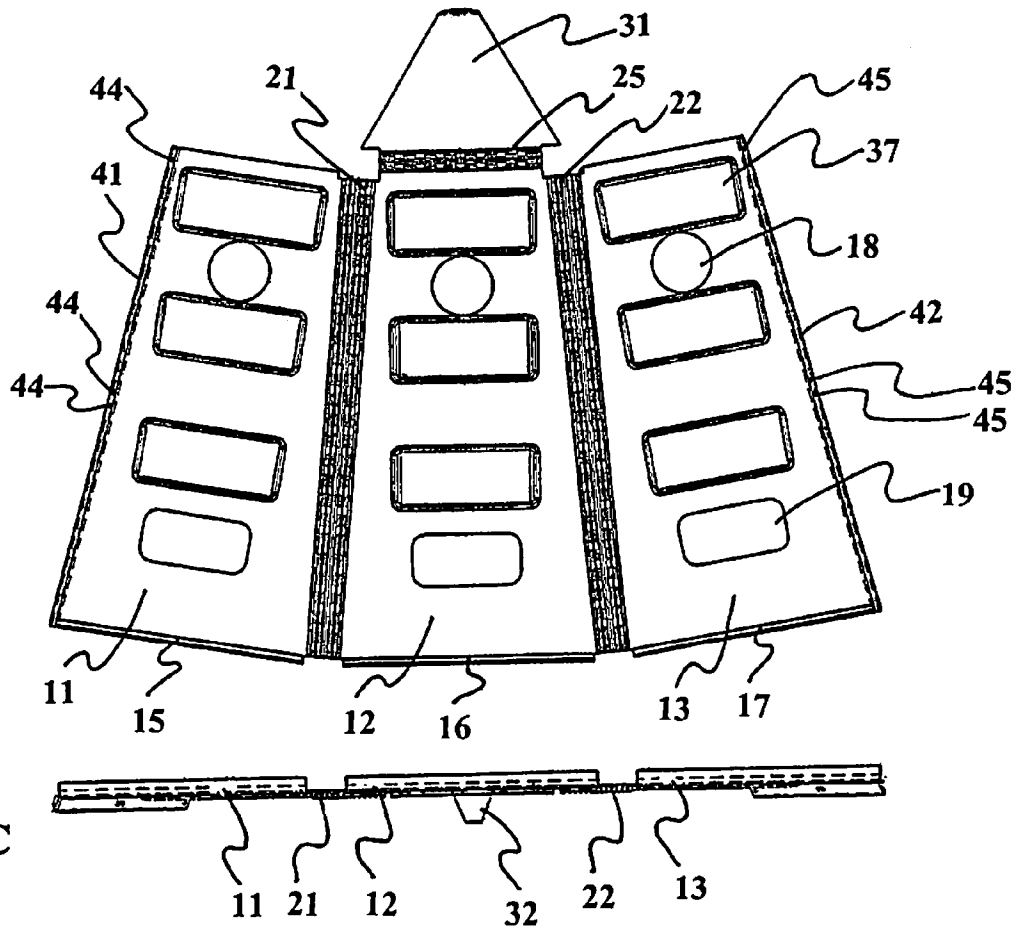
FIG. 2B
FIG. 2C
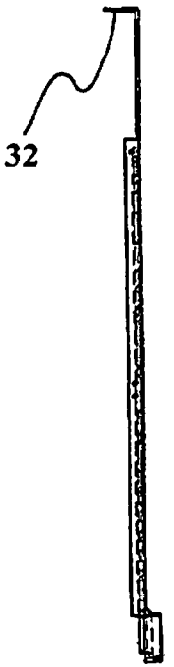
FIG. 2A

COLLAPSIBLE CONSTRUCTION BARRIER

RELATED APPLICATIONS

This application is a continuation of U.S. application Ser. No. 11/270,055, filed Nov. 9, 2005, now allowed, which is a continuation-in-part of U.S. application Ser. No. 10/984,053, filed Nov. 9, 2004, now abandoned, contents of which are incorporated herein by reference in its entirety.

FIELD OF THE INVENTIONS

The invention relates generally to structure of thermoformed objects and, more particularly, to improvements for collapsible type warning/safety barriers, construction/path barriers and related objects.

BACKGROUND OF THE INVENTION

Traffic barrels are well known for use in roadways, such as for warning drivers of hazards like road construction and repair. Such barrels may be a high visibility, plastic, and of a shape and size similar to a standard 55 gallon drum. Traffic barrels are typically yellow or orange in color and are formed of a thick plastic material that endures significant wear and tear while being relatively lightweight yet sturdy. A ballast material such as sand may be placed therein to keep a traffic barrel from being affected by wind or by being slightly jarred by being hit by a passing vehicle. The ballast also keeps the traffic barrel from tipping over and rolling into the path of oncoming traffic.

Other forms of warning barriers are used for various applications. For example, traffic cones having tip-resistant bases may be formed to be nestable/stackable, lightweight, and of various sizes and shapes. Warning markers may be formed to be disposable such as by being formed of cardboard that can be folded flat for storage and later assembled in a manner employing various tabs, slots, flanges, and bends of a type used, for example, in collapsible boxes. Folding plastic barriers are often used for identifying a wet floor or similar hazardous condition inside a public building.

Warning barriers that are collapsible have been formed of plastic. However, such barriers lack strength, integrity and durability, and are not optimized regarding their use, storage, and safety features.

OBJECTS OF THE INVENTION

It is an object of the invention to provide an improved collapsible barrier overcoming some of the problems and shortcomings of the prior art, including those referred to above.

Another object of the invention is to provide an improved hinge mechanism in a unitary thermoformed collapsible barrier.

Another object of the invention is to provide a collapsible barrier that is strong and durable while being lightweight and flattenable.

Another object of the invention is to provide a multiple-sided warning barrier that is foldable into a small folded footprint.

Still another object of the invention is to provide a collapsible barrier that is stable and secure when erected.

Yet another object of the invention is to provide a collapsible barrier that is adapted for easily being held down in order to resist movement of the barrier, for example by wind.

Another object of the invention is to provide an improved thermoformed hinge design that may be adapted for being implemented in a variety of products.

A further object of the invention is to provide a rugged construction barrier adapted for secure placement of an emergency light thereon.

Another object of the invention is to provide a construction barrier adaptable for being broken apart and/or unfurling when the barrier is struck by a vehicle.

How these and other objects are accomplished will become apparent from the following descriptions and the drawings.

SUMMARY OF THE INVENTION

According to an aspect of the invention, a collapsible barrier includes at least three integrally-formed wall sections with a plurality of living hinges, as a series, joining each adjacent pair of wall sections, endmost wall sections of the at least three wall sections being joinable to form an upright structure. It is preferred that the plurality of living hinges be contiguous living hinges.

According to another aspect of the invention, in a collapsible barrier having a plurality of wall sections formed together with wall living hinge members between adjacent ones of the wall sections, and having a top section formed integrally with and joined to the wall sections with a top living hinge member, an improvement includes the wall living hinge members and the top living hinge member each having a thermoformed plurality of living hinges formed as a series, the collapsible barrier being a unitary structure.

According to a further aspect of the invention, a collapsible barrier includes a plurality of interconnected wall sections each having a top-facing side, where one of the top-facing sides has a pocket adapted for securely holding a light.

According to another aspect of the invention, a collapsible barrier having at least three integrally-formed wall sections includes first and a second endmost wall sections adapted to be joined to one another for erecting the collapsible barrier, the first and second endmost wall sections each having an outward-facing wall with a top side and a projecting portion on the respective outward-facing wall adjacent the respective top side. The collapsible barrier also includes perimeter sides of the first top section having first and second sidewalls each approximately orthogonal to the top surface, each of the first and second sidewalls having an inward-facing wall with a projecting portion. In addition, when the first and second endmost wall sections are joined to one another and the first top section is urged downwardly onto the first and second endmost wall sections, the projecting portions of the first and second sidewalls are engaged with respective ones of the projecting portions of the first and second endmost wall sections, thereby securing the first top section to the wall sections.

According to an additional aspect of the invention, a thermoformed unitary structure, particularly a thermoformed collapsible barrier, includes a plurality of wall sections, each wall section having two longitudinal sides, and at least one wall hinge member connecting adjacent interior ones of the wall sections' longitudinal sides, each such wall hinge member comprising a plurality of living hinges interconnected as a series.

According to a still further aspect of the invention, a thermoformed collapsible barrier includes at least two wall sections, at least one hinge member connecting adjacent interior ones of the wall sections' longitudinal sides, the hinge member including a plurality of interconnected living hinges, where a nominal thickness of the at least one hinge member of the thermoformed collapsible barrier approximates 0.100 inch.

In another aspect of the invention, a method is provided for forming a collapsible barrier having at least one elongate rib separating adjacent ones of a plurality of living hinges, the plurality of living hinges connecting two wall sections, the method including determining a range of travel for the plurality of living hinges, determining a desired force distribution profile for the range of travel, and implementing the desired force distribution profile for the plurality of living hinges by selecting a ratio of a width of the elongate rib to a minimum thickness of the adjacent ones of a plurality of living hinges.

In another aspect of the invention, a method includes providing a collapsible barrier comprising at least three integrally-formed wall sections with a plurality of living hinges, as a series, joining each adjacent pair of wall sections, endmost wall sections of the at least three wall sections being joinable to form an upright structure, and providing a keeper structure operative to securely hold the wall sections together in a collapsed state having a footprint essentially of one of the wall sections.

As a result of implementing the invention, improvements are obtained for collapsible barriers including, but not limited to, enhanced durability, reliability, and a longer usable life.

The foregoing summary does not limit the invention, which is instead defined by the attached claims.

BRIEF DESCRIPTION OF THE DRAWINGS

FIGS. 2A-2C respectively show end, top, and front views of the collapsible barrier of FIG. 1 in a fully collapsed or flattened state.

FIG. 13A shows endmost wall sections being unjoined and FIG. 13B shows the endmost wall sections being joined to one another.

DETAILED DESCRIPTION

Figure 1:
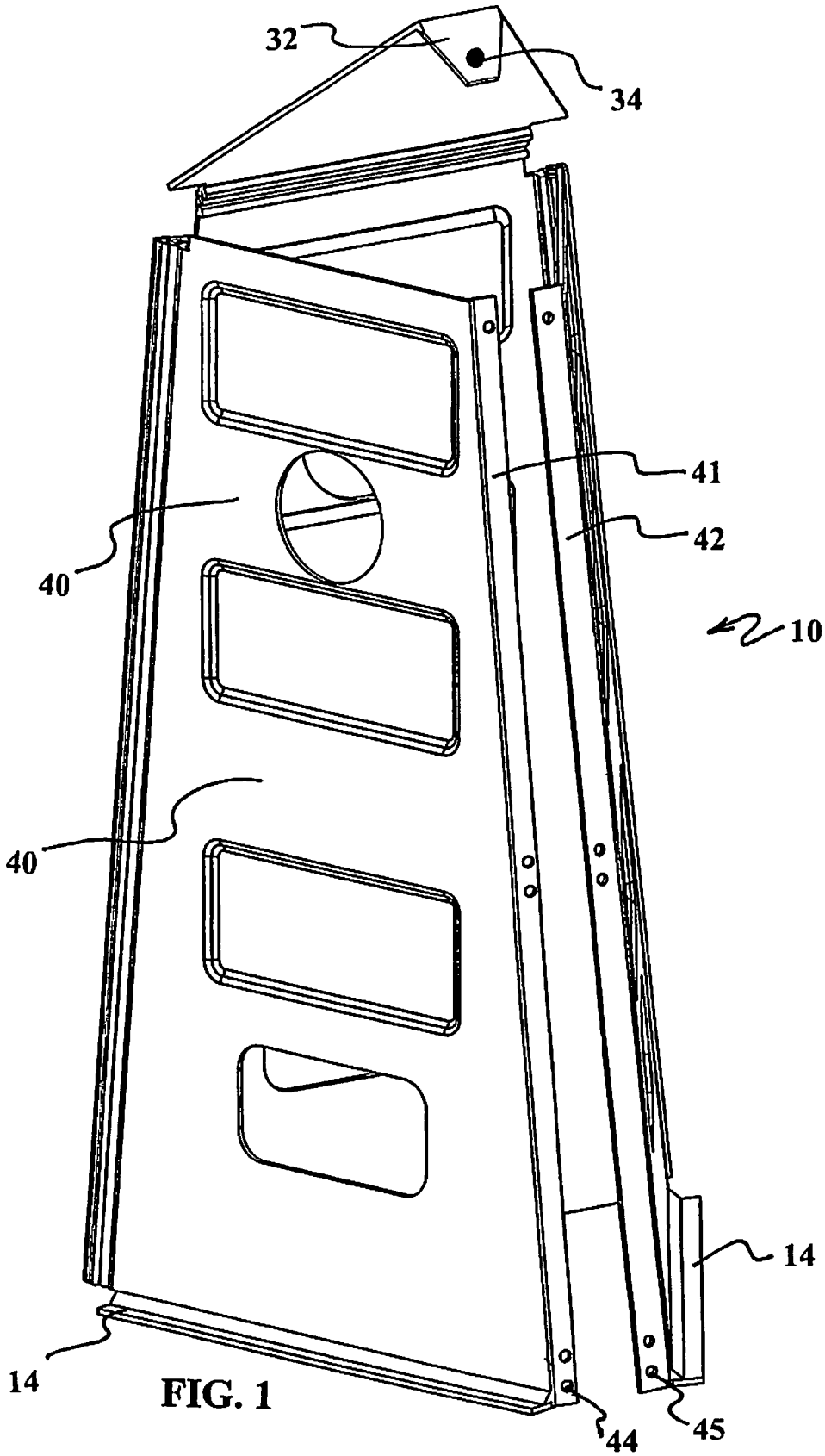
FIG. 1 is a perspective view of a collapsible barrier according to an exemplary embodiment of the invention.
Figure 3:
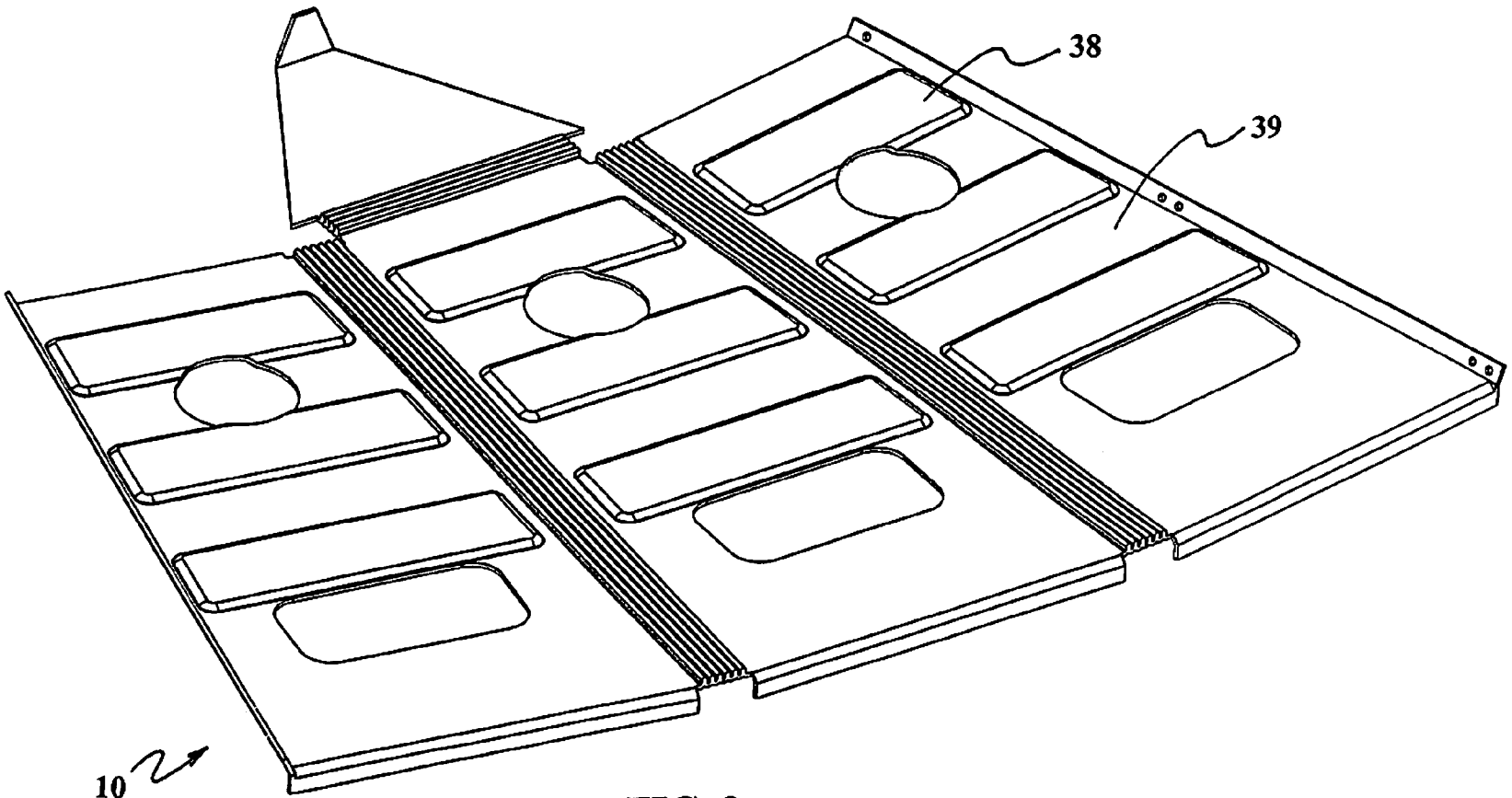
FIG. 3 is a perspective view of the collapsible barrier of FIG. 2B in a fully collapsed or flattened state.

FIG. 1 is a perspective view of a collapsible highway safety barrier 10 in a partially folded state, according to an exemplary embodiment of the invention. FIGS. 2A-2C respectively show end, top, and front views of the collapsible highway safety barrier 10 of FIG. 1 in a fully collapsed or flattened state, and FIG. 3 is a perspective view of the flattened barrier 10 shown in FIG. 2B.

Collapsible highway safety barrier 10 is a unitary structure having a first wall section 11, a second wall section 12, and a third wall section 13. First wall section 11 is connected to second wall section 12 by a hinge portion 21, and second wall section 12 is connected to third wall section 13 with a hinge portion 22 essentially identical to hinge portion 21. A top wall portion 31 is connected to second wall section 12 via an upper hinge portion 25. First, second, and third wall sections 11, 12, 13 have bottom flange portions 15, 16, 17, respectively, that each extend away orthogonally outward from the particular wall section.

Wall sections 11, 12, 13 each have a number of recessed portions 37 each having a shape defined by four sides that form a rectangle. Alternatively, recessed portions 37 may each be defined by four sides that are essentially parallel to the four peripheral edges of the given wall section. For example, recessed portions 37 on a given wall section 11, 12, 13 may each have the same dimensions, as shown by example in FIG. 2B, or the recessed portions 37 on a given wall section 11, 12, 13 may have dimensions that become smaller going from the bottom to the top of safety barrier 10.

Recessed portions 37 provide a convenient surface for application of reflective tape or reflective paint (not shown), providing additional visibility that assists the general warning function of safety barrier 10. For example, fluorescent and/or iridescent pigments having an optimized light-scattering property may be used in adhesive tapes or paints to provide maximum reflection when illuminated by an automobile's headlights. By placing such reflective surfaces in the recessed portions, abrasion and damage to the reflective surfaces is greatly reduced, such as when safety barriers are being stored or transported. In addition, a protective coating may be used for increasing durability of reflective surfaces. In a preferred embodiment, reflective panels (not shown) may be placed on the outward-facing sides of recessed portions 37 to increase visibility and reflection of light, for example from the headlights of an automobile or other vehicle. Such reflective panels preferably are formed of nylon, vinyl, mylar, resin, thin metal, or similar backing material, and have an adhesive for attachment to a given one of the recessed panels 37. The reflective panels preferably have a multiple pattern of reflection on their outward-facing sides, such as a fish scale pattern combined with rectangles of a number of shapes, sizes, and incident surfaces, so that light may be reflected to and be incident from various directions. Any number of recessed panels 37 may be used on a given wall section, although three or four recessed panels are preferably used.

As shown in FIG. 3, recessed portions 37 each have a back side surface 38 that is a projecting type surface on the interior part of safety barrier 10. As a result, an ersatz "ribbed" structure is formed on the outer surfaces of wall sections 11, 12, 13 by the alternating use of recessed portions 37 and exterior surfaces 40, and by the alternating use of back side surfaces 38 and interior surfaces 39. Such a ribbed construction adds to the structural integrity of safety barrier 10, thereby adding strength and resistance to deformations.

Wall sections 11, 12, 13 each have a round hole 18 and a rectangular hole 19. Holes 18, 19 are in a respective same location for each wall section 11, 12, 13. Accordingly, holes 18, 19 are at a same respective height for each corresponding wall section 11, 12, 13. Round holes 18 have, for example, a four-inch diameter. Rectangular holes 19, for example, have a dimension of four inches by eight inches, six inches by ten inches, etc. A pipe (not shown) or similar structure may be passed through two round holes 18 of collapsible highway safety barrier 10. Such a pipe may then be passed through round holes 18 of an adjacent collapsible highway safety barrier 10, etc., so that a series of collapsible highway safety barriers 10 are interconnected by the pipe. By thus interconnecting the individual barriers 10 into an interconnected series using a pipe, the barriers 10 may be put and/or kept in proper alignment with respect to one another. In addition, the pipe may be anchored at one or more points along its length for thereby anchoring the series of barriers 10. For example, the pipe may be tied to permanent structures, weighted, etc. Alternatively, various other apparatus including, but not limited to, wire, rope, tubing, and/or rebar may be passed through round holes 18 for interconnecting a series of barriers.

Similarly, a rectangular object, for example a board, may be passed through two rectangular holes 19 of collapsible highway safety barrier 10. Such a board may then be passed through rectangular holes 19 of an adjacent collapsible highway safety barrier 10, forming a series of barriers 10 as just described for the case of round holes 18. For particular applications, it may be more practical to use the lower, rectangular holes 19 for anchoring barriers 10, thereby taking advantage of the lower anchor placement and reducing angular torque effects and the like. The relatively large opening of rectangular holes 19 and their low placement also allows use of sandbags and similar devices for assisting the anchoring/ballasting.

Outwardly-extending flanges 14 are formed along the respective bottom edges 15, 16, 17 of wall sections 11, 12, 13. Flanges 14 each have a bottom surface that is formed to be parallel to the roadway or other incident surface when collapsible highway safety barrier 10 is assembled and standing upright. Such bottom surface thereby helps to stabilize barrier 10. First and third wall sections 11, 13 have respective inwardly-angled connection faces 41, 42 that are formed to be in parallel with one another when barrier 10 is being assembled. Faces 41, 42 are connected together using wire or cable-ties (not shown) that are passed through holes 44, 45 aligned with one another. Preferably, holes 44, 45 are aligned when faces 41, 42 overlap, so that a single hole is formed by concentric holes 44, 45. Various alternative devices and structure may be used for joining faces 41, 42, such as hook-and-loop fasteners, pins, locking mechanisms, plugs, snap connectors, and others.

Top surface 31 is formed with a triangular shape truncated by an extending flap section 32. Flap section 32 has a snap connector 34 that aligns with holes 44, 45 when top surface 31 is folded down to form an essentially horizontal top surface of barrier 10, whereupon snap connector 34 may be snapped into the overlapping holes 44, 45. Alternatively, a hole (not shown) may be formed in place of snap connector 34. In such a case, for example, a wire-tie or other fastener may be inserted through aligned holes for securing top surface 31 in an assembled position. Alternatively, other fasteners may be used for securing flap section, such as one or more clip connectors, pins, hook-and-loop fasteners, etc.

Figure 4:
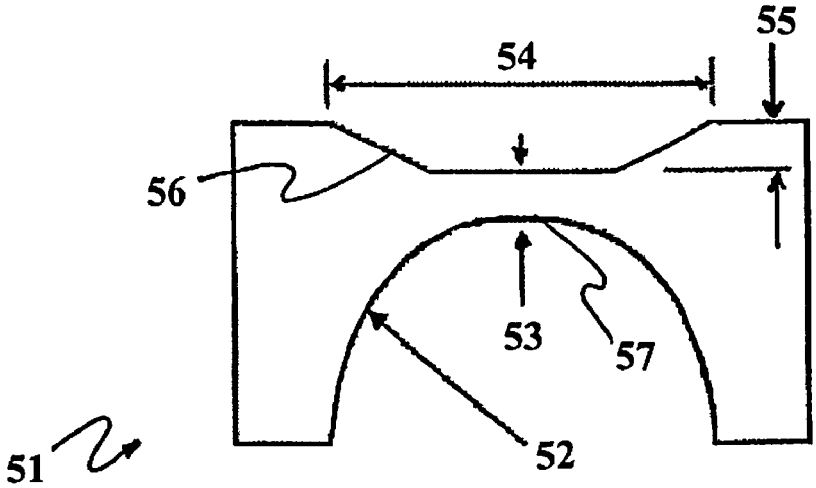
PRIOR ART FIG. 4
FIG. 4 is a schematic view of a living hinge.

Hinge portions 21, 22 are each formed as a series of individual so-called "living hinges" 51, shown by example in FIG. 4. Conventionally, a living hinge is used as a single section and is not used in a series or a contiguous series. By implementing each of hinge portions 21, 22, 25 as series of living hinges 51, angular displacement, occurring between a flattened condition and an assembled condition of a barrier 10, is thereby distributed among the plurality of individual living hinges 51 of a hinge section. By distributing the stress and strain among a plurality of living hinges 51 in a contiguous series, a thicker material may be used and elasticity is obtained as an aggregate of bendability of the series of hinges, and an elastic region of individual living hinges is optimized. For example, wall section 11 is moved 120 degrees between the flattened condition of FIG. 2B and the assembled condition of FIG. 1; by using multiple living hinges 51 in a contiguous series, hinge portion 21 distributes the 120 degree angular rotation among those individual living hinges 51. Individual living hinges 51 are not strained beyond a point where permanent deformation of the plastic can occur. Therefore, the plastic will recover its shape after a flex and have a longer life.

Living hinge 51 has a hinge radius 52 that helps orient the polymer molecules and also determines how a bending force is distributed when folding a wall section. Molecular orientation provides hinge 51 with strength and a long life. A land 56 having a land length 54 is formed on a side of living hinge 51 opposite hinge radius 52 for further reducing a possibility of cracking and undue concentration of stress, preventing notching, and for providing a smoother hinging action when living hinge 51 is folded. A bending portion 57 of living hinge 51 has a hinge thickness 53 at a minimum width location.

Figure 5:
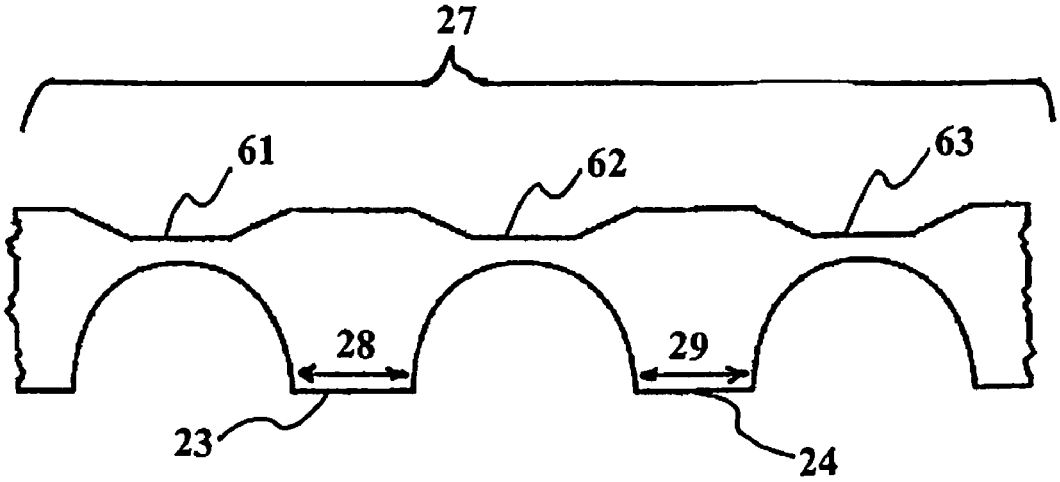
FIG. 5 is a schematic view of a series of adjacent living hinges according to an exemplary embodiment of the invention.

FIG. 5 is a cross-sectional view of an exemplary hinge portion 27 formed as a series of contiguous individual living hinges each having individual parameters described generically for living hinge 51 of FIG. 4. As that term applies to the invention, a "series" describes an adjacent plurality of living hinges formed to have longitudinal rib sections between each living hinge of the form shown in FIG. 4. As the term "contiguous" applies to the invention, a plurality of contiguous living hinges includes hinges which have a common boundary and hinges that connect without a break. In the FIG. 5 example, adjacent living hinges 61, 62, 63 are separated from one another by ribs/ridges 23, 24. In a given series of adjacent living hinges 61, 62, 63, for example, a width of ridge 23 may be one-half to four times a corresponding hinge radius 52, depending on the material used, the hinge thicknesses 53, and depending on the number of living hinges 51 in the given hinge portion, etc. A width 28 of rib 23 may be the same as a width 29 of rib 24, or the widths 28, 29 may be varied to account for different stress vectors that occur when folding and unfolding hinge section 27.

Similarly, living hinges 61, 62, 63 may be formed with identical dimensions (described generically with reference to FIG. 4), or such dimensions may be varied to optimize a distribution of stress and strain, such as for achieving a long hinge life. For example, increasing a hinge width 53 of living hinge 61 to be larger than hinge widths of living hinges 62, 63 acts to transfer a certain amount of bending force to hinges 62, 63, thereby spreading out or distributing such bending force. Relative locations of radii 52 of living hinges 61, 62, 63 and a bend volume relationship between such living hinges may vary according to a number of living hinges being used in hinge section 27, the size and weight of wall sections 11, 12, 13 and top section 31, and according to other factors such as ambient temperature specifications of the plastic material. Dimensions of rib widths 28, 29, living hinge recesses 61, 62, 63, and related thicknesses may be specified according to calculations of vector components, material properties, anticipated velocities of movement, aging requirements, ease of bending, number of longitudinal ribs, mass, and by considering other parameters.

For example, when determining relative dimensions for a series of living hinges 61, 62, 63 and the corresponding rib widths 28, 29 therebetween, a designer may first determine a range of travel for the plurality of living hinges, individually, or for adjacent wall sections 11, 12 being joined by the hinge section 27. Next, the designer may select a desired force distribution profile for the range of travel based on the individual application. For example, a hinge section 27 formed of a given thickness may have a stiffer action when the number of hinge sections is less, the thicknesses of materials are greater, etc. In such a case, altering rib widths 28, 29 may provide an easier relative hinging action by transferring force more efficiently. Similarly, changing a radius 52 of individual living hinges in order to achieve a desired ease of hinging movement may result in a tradeoff result of a slightly lower hinge lifetime. In another example, when the desired force distribution profile has been determined for the hinge section 27 and its series of living hinges, the designer may choose to implement such profile for the series of living hinges by selecting dimensions according to ratios/interrelations between width(s) 28, 29 of given elongate rib(s), minimum thickness(es) 53 of the bending portion(s) 57 of corresponding adjacent living hinges 61, 62, 63, radi(I) 52 of given living hinges, length(s) 54 and/or depth(s) 55 of land(s) 56 of given living hinge(s), etc. Such interrelated dimensioning may be defined according to a relational database for degrees of freedom corresponding to the variables at the designer's disposal. Different patterns may be used to filter such a database, for example as a homogenous series where each individual living hinge of the series has the same dimensions, as a progressive series where chosen dimensions increase/decrease for adjacent living hinges of a series according to a curve (e.g., linear, non-linear, exponential, etc.), as a cold temperature series where dimensions and material composition are optimized for resistance to cracking, and others including, but not limited to, combinations of series' definitions. One skilled in the art will easily determine additional patterns and modifications to be implemented in a series of living hinges and in a series of contiguous living hinges.

Collapsible highway safety barrier 10 is shown in FIG. 3 with hinge sections 21, 22 each having a series of five adjacent and contiguous living hinges. It may be impractical to use a larger number of living hinges for a given hinge section due to tooling and thermoforming manufacturing, and associated yield and expense. This may vary according to a size of a hinge section and the particular material used.

Collapsible highway safety barrier 10 may be thermoformed of High Molecular Weight Polyethylene (HMWPE), such as resin available from Phillips, Paxon, Allied Chemical, Solvay Polymers, and others. The HMWPE may include a blend of additional materials such as regrind and others, and may be formed using Kynar and similar materials. HMWPE has superior dielectric and tensile strength. In addition, it is resistant to water, most organic or inorganic substances, mildew and sunlight. Further, HMWPE is lightweight, cleanable, impact resistant, and has appropriate flex memory properties.

Since fibers of the plastic may be somewhat random in orientation, orienting the fibers prolongs the hinge life. Orientation of the HMWPE molecules in the living hinge portions 21, 22, 25 may be improved by flexing the hinges when still warm from the thermoform cycle, thereby improving durability and reducing the possibility of premature hinge failure. Coining may optionally be performed to give the living hinge enhanced properties. For example, it may keep the stress in the outer fibers from exceeding the yield strength when being flexed. A coining process compresses the hinge to a pre-determined thickness. The strain induced is greater than the yield stress of the plastic. Thereby, the hinge is plastically deformed, placing it outside the elastic range into the plastic range. An amount of coining (compression) should be less than the ultimate stress, to keep the hinge from fracturing.

Thermoforming of collapsible highway safety barrier 10, for example, may use a vacuum type process where a sheet of hot plastic is positioned over a male or female mold. Such mold travels to the sheet and penetrates the sheet line to create a seal. Applying vacuum to the mold draws out the air between the sheet and the mold. A water-cooling system may be used in the mold for cooling the sheet down to the specific material's set temperature, whereupon air is blown back through the mold to separate safety barrier 10 from the mold.

Optionally, a part of safety barrier 10 may be thermoformed using a twin-sheeting type process, where separate sheets of material are each formed on a separate mold and are then brought together. Such molded sheets are then welded together at specific contact points and the perimeter is sealed. A twin sheeting process may use a combination of pressure-forming and vacuum-forming to create hollow areas in selected portions of safety barrier 10. Such hollow portions may be filled with a rigid foam to give added strength, or may be formed with inserts between the two sheets. A mold for twin sheeting has machined contact points for obtaining a high quality bond, and blow pins are used to supply air pressure in the hollow areas to assist in forming and to provide better part cooling.

In addition, thermoforming of safety barrier 10 may include a pressure forming process using compressed air to push on the backside of the plastic material, thereby providing increased definition off the mold surface. Such a process allows for providing various textures and surface detail, such as sharper corners and better logo or letter definition. Pressure forming may also provide greater accuracy and tighter tolerances from part to part. Tooling for pressure forming is generally more expensive than vacuum-forming due to a greater level, yet still relatively inexpensive compared with traditional injection-molding. Pressure-forming tooling may be cast or machined aluminum. A pressure box or plate is required to seal the perimeter to allow the compressed air to force the material to the mold surface.

Plastics may be formed with different colors on the respective exterior and interior portions of barrier 10. For example, a less-expensive, black, re-grind type resin may be used in forming an inner portion of barrier 10, while a more expensive, brightly colored, virgin type resin may be used in forming an outer portion. Since the inner portion will not be seen when barrier 10 is assembled, a cost savings in manufacturing barrier 10 is achieved by the use of different materials. Various methods may be used in forming such a structure, such as a known co-extrusion process where the materials are purchased in desired thicknesses. For example, the re-grind/virgin ratio may be selected as 80/20, and the corresponding thicknesses may be effected by using 0.100 re-grind stock in a co-extrusion with 0.025 virgin stock.

All dimensions relative to the living hinges 51 should be uniform. For example, the hinge thickness 53, rib 23, 24 width and thickness, and thickness of adjacent walls 11, 12, 13, 31 should be constant to avoid undue stress and strain caused by creating weak points. The molecular weight and melt flow index of the HMWPE may be varied to obtain an optimum combination of strength, elasticity, and resistance to tearing. In addition, parts may be compared under ultra-violet light, for example, to determine material flow differences as an indicator of gating and venting, gassing, material filling, overpacking, and other thermoforming problems or parameters such as molecular weight distribution due to use of temperature, additives, etc. and/or moisture-related conditions and other contamination. Analysis of crystallization, including the time and nature of formation, is also useful in optimizing the thermoforming process and resultant performance characteristics of living hinges 51. In alternate embodiments, materials such as polypropylene resin and others may be used in forming collapsible highway safety barrier 10. Further, other methods may be used such as twin sheet molding, injection molding, etc.

Figure 7:
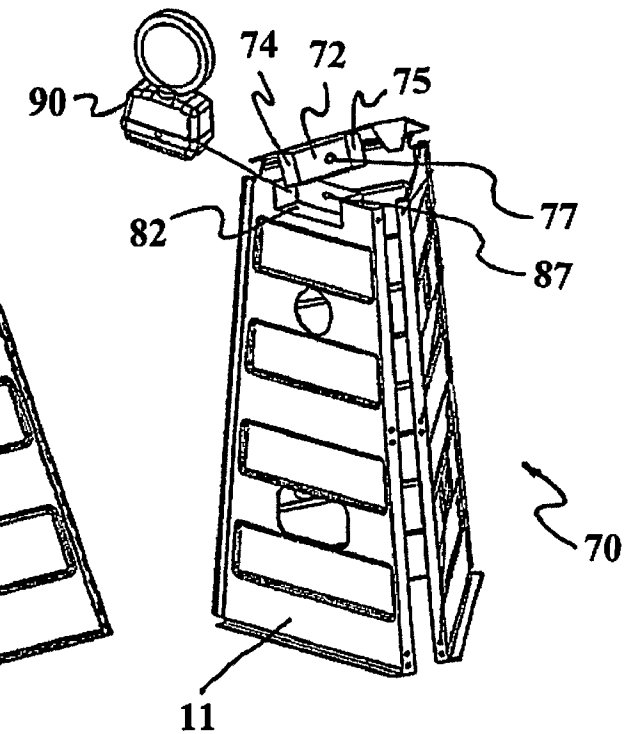
FIG. 7 is a perspective view of the collapsible barrier of FIG. 6 in a partially assembled state.
Figure 6:
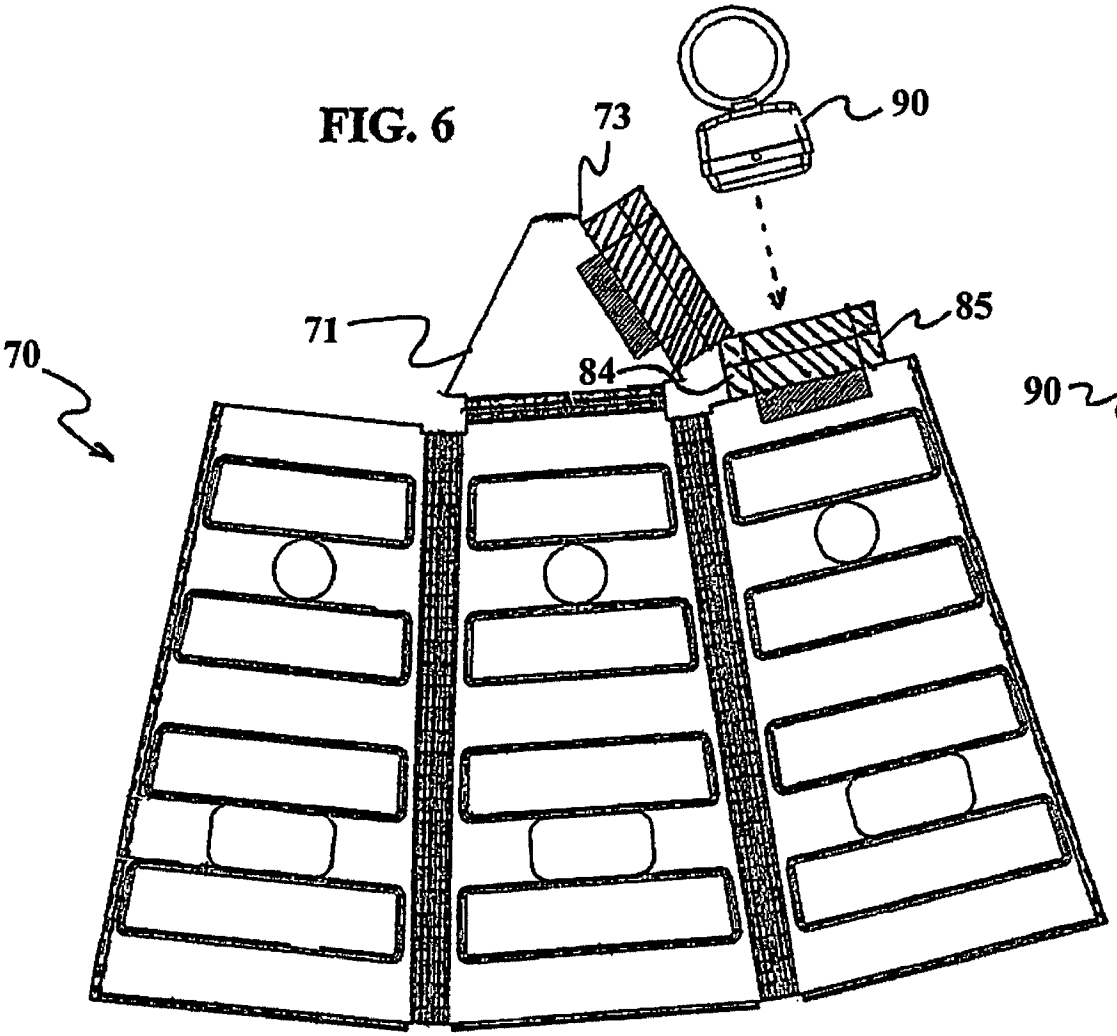
FIG. 6 is a top view of a collapsible construction barrier in a fully collapsed or flattened state according to an exemplary embodiment of the invention, where the collapsible construction barrier is adapted for receiving an emergency light when assembled.

FIGS. 6 and 7 respectively show a flattened-out view and a perspective view of an embodiment adapted for securing a warning light. Collapsible highway safety barrier 70 has a top surface 71 with a pocket 72 extending along a portion of a free edge 73 and formed as four surfaces (of a possible six surfaces) of a rectangular "box." The end side flaps 74, 75 of pocket 72 are attached to only one other surface of pocket 72, enabling pocket 72 to be folded flat when moving or storing safety barrier 70. A corresponding wall pocket 82 is formed in first wall section 11, and has a rectangular box type shape that snugly engages with pocket 72 when assembling collapsible highway safety barrier 70. The end side flaps 84, 85 of wall pocket 82 are attached to only one other surface of wall pocket 82, enabling pocket 82 to be folded flat. Pocket 72 has a hole 77 that aligns with a hole 87 in wall pocket 82 when safety barrier 70 is assembled. A wire tie, wire, snap connector, locking mechanism, or other device may be used for securing pockets 72, 82 to one another via aligned holes 77, 87. In addition, or as an alternative, such a fastening/connecting device may be used for securing an emergency light 90 to pockets 72, 82, for example in a manner where emergency light 90 is both securely held and protected from theft or vandalism. Emergency light 90 is preferably a battery-operated light such as a model 400 light available from Empco-Lite, or similar apparatus.

The following discussion is provided to illustrate but a few examples of improvements determined by the present inventor. In one example, conventional portable temporary markers such as "traffic barrels" and the like are used in roadways for the purpose of warning drivers of hazards like road construction and repair. Such traffic barrels may be formed of a high-visibility yellow or orange colored thick plastic for enduring significant wear and tear while still being relatively lightweight, and of a shape and size similar to a standard 55-gallon drum. Ballast materials such as sand may be placed in such traffic barrels to keep them from being moved by wind or by slight jarring as when contacted by passing vehicles. Traffic barrels are often used at job sites in great numbers, sometimes hundreds or even thousands of essentially identical barrels. One major drawback of such portable traffic markers is that carrying large numbers of such devices to or from job sites difficult and time-consuming because of the volume of each of such devices and the consequent fact that only a limited number of such devices can be placed in or on a single vehicle. Storing such devices during periods of non-use is problematic and expensive for the same reason. By comparison, the collapsible barriers of the present invention may be transported in much higher quantity, thereby providing many logistical advantages such as reduced labor costs, higher efficiency, and less chance of related accidents.

In a second example, another form of conventional portable temporary marker is the so-called "traffic cone." Traffic cones partially address the transportation and storage problems referred to above, particularly if they are nestable and stackable. However, traffic cones have limited use. By comparison, the collapsible path barrier of the present invention provides a system that may be stored or shipped flattened, is highly visible, provides a prohibitive deterrent to intrusion, provides support for warning lights, may be interlocked, is adaptable for securement, and that provides additional advantages over a traffic cone.

As another example, conventional efforts have been made toward development of portable collapsible markers for various warning purposes, such use for marking wet floor areas in buildings during the carrying out of janitorial duties or for marking other hazardous conditions. For example, certain folding cardboard or plastic structures have been developed. Such collapsible markers typically lack strength and durability, have limited versatility, and are not suitable for use in connection with road construction, road work, and the like. While a conventional fully-collapsible portable temporary marker device may be carried in or close to flat sheet form, the lack of strength and durability are significant issues. Such issues may particularly be apparent during usage in widely varying temperature conditions. Certain plastic devices may more easily be erected or collapsed during warm or hot conditions, but even then plastic properties may be problematic. During cold conditions, however, the folding (for marker erection) or unfolding/flattening (for marker collapse) can in some cases place major stresses on materials and a tendency to fracture. By comparison, the present invention minimizes a volume of the structure during storage between jobs or during transportation to or from job sites, while greatly improving strength, reliability and product life.

As a further example, conventional products have addressed similar problems by minimizing certain plastic dimensions in areas of folding and unfolding. However, such minimizing of dimensions also weakens materials and creates additional problems for portable temporary markers used for traffic-marking purposes. By comparison, the present inventor has addressed a need for improvement in portable temporary markers and barriers for road construction purposes and the like. Thereby, conventional problems are reduced by providing an improved portable temporary barrier that, for example, is highly durable such that it can readily withstand the rigors of use for road-construction and road-project marking, can easily be erected (e.g., for use) and collapsed (e.g., for storage and/or transportation purposes), is nestable even in erected condition, can readily be erected and collapsed even in extreme temperature conditions as is necessary, and that is versatile in use in allowing placement of individual barriers for warning purposes or in allowing use of a plurality of structures for barrier-formation purposes.

These and additional improvements over conventional structures may be achieved, for example, by implementing the series of living hinges in a variety of similar structures having thermoformed walls. For example, in a series of interconnected living hinges, a ratio of a lateral width of a longitudinal rib to at least one of the radial curvatures of individual adjacent living hinges of the series may be based on a desired transfer of bending force between the adjacent living hinges. Such a series of interconnected living hinges may have a corresponding series of the longitudinal ribs formed so that lateral widths of each longitudinal rib in the series of longitudinal ribs are essentially the same. Alternatively, a series of interconnected living hinges may include a series of longitudinal ribs where sequential lateral widths of the series of longitudinal ribs increase according to a bending paradigm. For example, the sequential lateral widths of the series of longitudinal ribs may be designed to increase according to an exponential function. A chosen pattern of dimensions for a series of living hinges may implement the bending paradigm based on an operating temperature range for the series of interconnected living hinges.

Figure 8:
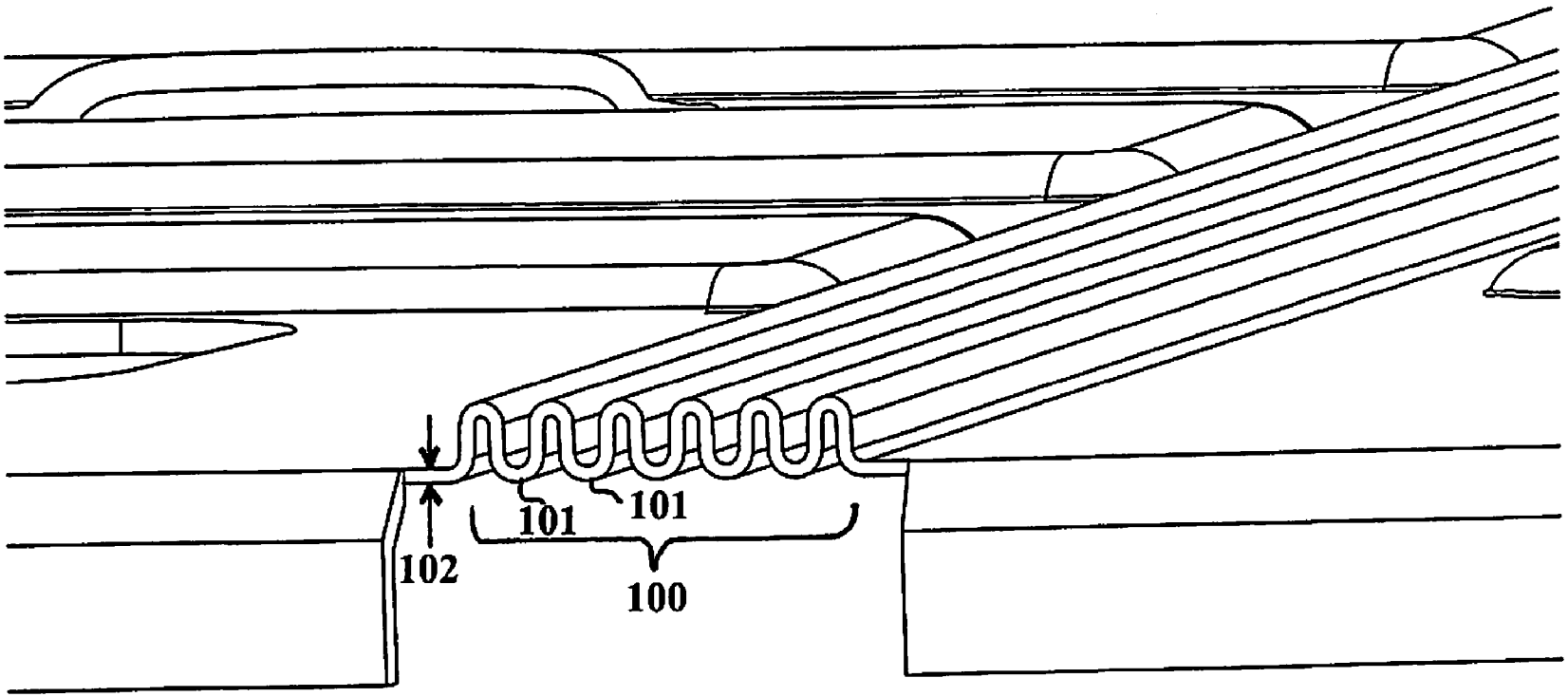
FIG. 8 is a perspective view of a series of living hinges formed as an essentially constant width, serpentine-like structure, according to an exemplary embodiment of the invention.

FIG. 8 is a perspective view of an embodiment having a series 100 of living hinges 101 formed contiguously with an essentially constant width, serpentine-like structure. That is, a wall thickness 102 is maintained at a same thickness throughout the series 100 of contiguous living hinges 101. In an exemplary preferred embodiment, thickness 102 may be determined by using 0.125 material and then drawing down (stretching) the material to achieve a final thickness 102 of approximately 0.090 inches. Various known methods may be employed for controlling dimensional tolerances. A preferred embodiment may have a thickness 102 in a range of approximately 0.050 to 0.150 inches. A nominal thickness 102 in such preferred embodiment may be chosen to be 0.100 inches, which results in high durability while remaining flexible. However, the designer's choice for thickness 102 may be based on considerations of durability versus cost because a thicker product typically has a higher unit cost. Series 100 may be formed in serpentine fashion as continuous "S" type hinges 101 each having the same profile and dimensions but, similar to the case of hinge portion 27, living hinge series 100 may alternatively be comprised of individual hinges with varying dimensions. Other nominal thicknesses may be chosen, for example 0.157, 0.187, etc.

In addition, a thickness 102 may have a profile chosen to allow wall sections 11, 12, 13 to be "foldable," one onto another. For example, when living hinge sections 21, 22 are each formed with a smaller thickness 102 and an expanded, less tightly compressed living hinge series 100, wall section 11 may be folded so that it lies flat against wall section 12. In the same manner, wall section 13 may be folded so that it lies flat against wall sections 11 and 12. Thereby, the folded barrier 10 has a folded "footprint" that is essentially the dimension of wall section 12, plus the folded area of hinge sections 21, 22. Of course, the profile of hinge sections 21, 22 may be designed to accommodate the folding in an optimized manner. For example, thickness 102 may be smaller, S-hinges 101 may be selectively spaced apart or of a varying width, etc. The folded hinge sections 21, 22 typically have a memory and a certain amount of "spring-back," so that a chosen profile for hinge sections 21, 22 may account for resistance to and/or diminishing of such hinge properties. Generally, the greater the number of individual hinges in a hinge series 100, the easier the given hinge section may be adapted for folding. These and other factors may be accounted for when designing a multiple wall section barrier to be foldable.

When barrier 10 is in the folded condition, rectangular holes 19 and round holes 18 of all three wall sections 11, 12, 13 are preferably aligned, respectively, with one another. Such provides additional advantages, for example by stacking the folded barriers 10 onto one or more posts via hole(s) 18, 19, a storage space having a narrow width may be implemented while also preventing lateral sliding or misalignment of stacked and folded barriers 10. In another example, stacked and folded barriers 10 may be tied together via holes 18 and/or 19 using one or more straps, cords, ropes, wires, etc. In addition, a large number of folded barriers 10 may be stored and erected in an extremely efficient manner compared with traditional traffic barriers. The ability to store multiple barriers in a small area provides efficient warehousing and allows a user to achieve previously unmet levels of production as a result of a small footprint for the folded barriers. For example, a flatbed truck or similar barrier-distributing structure is able to store and transport greater numbers of barriers per unit area, and a smaller flatbed truck may be used compared with conventional traffic barrels.

Figure 9:
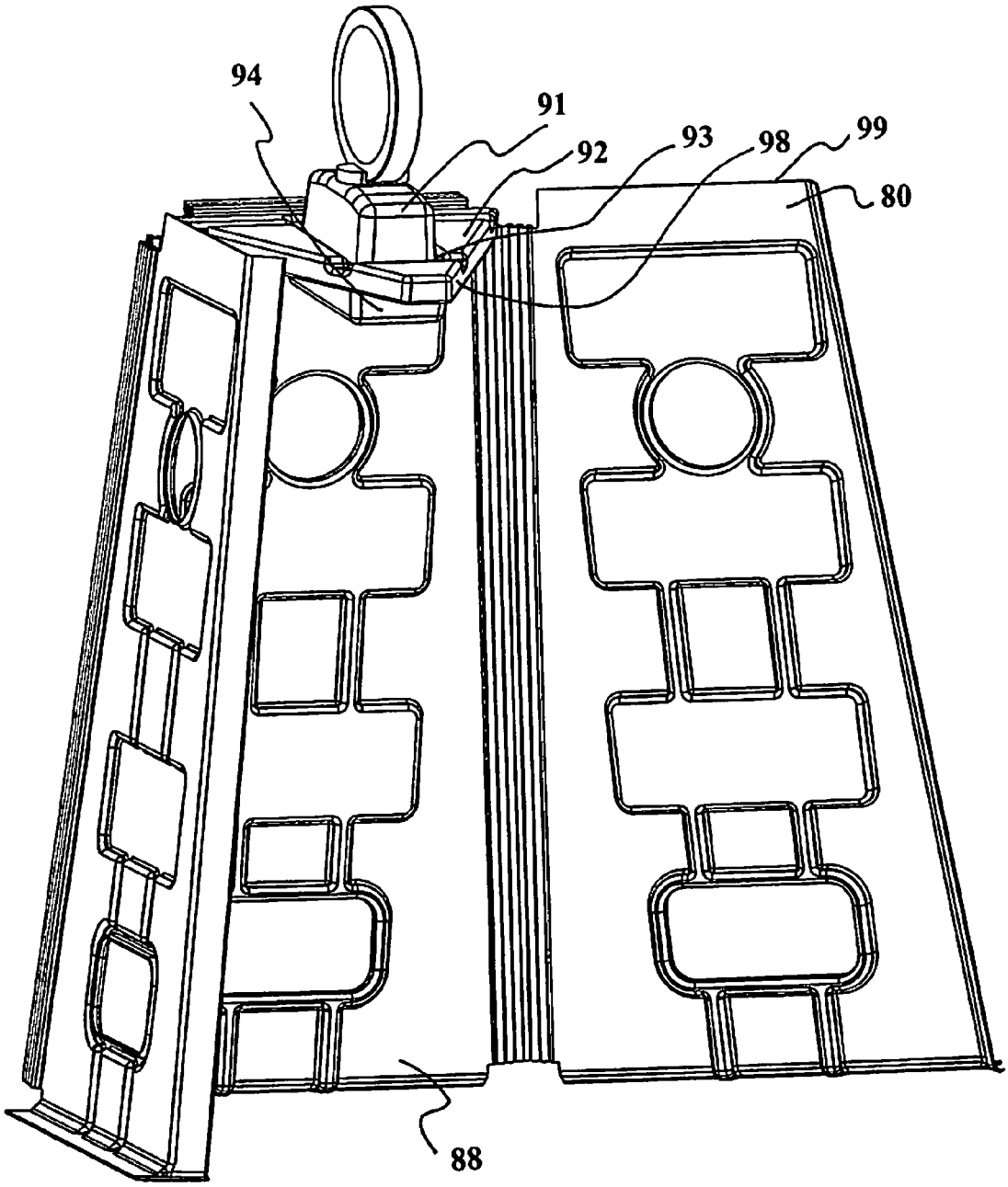
FIG. 9 is a perspective view of a collapsible construction barrier in a partially assembled state and having an emergency light, according to an exemplary embodiment of the invention.
Figure 10:
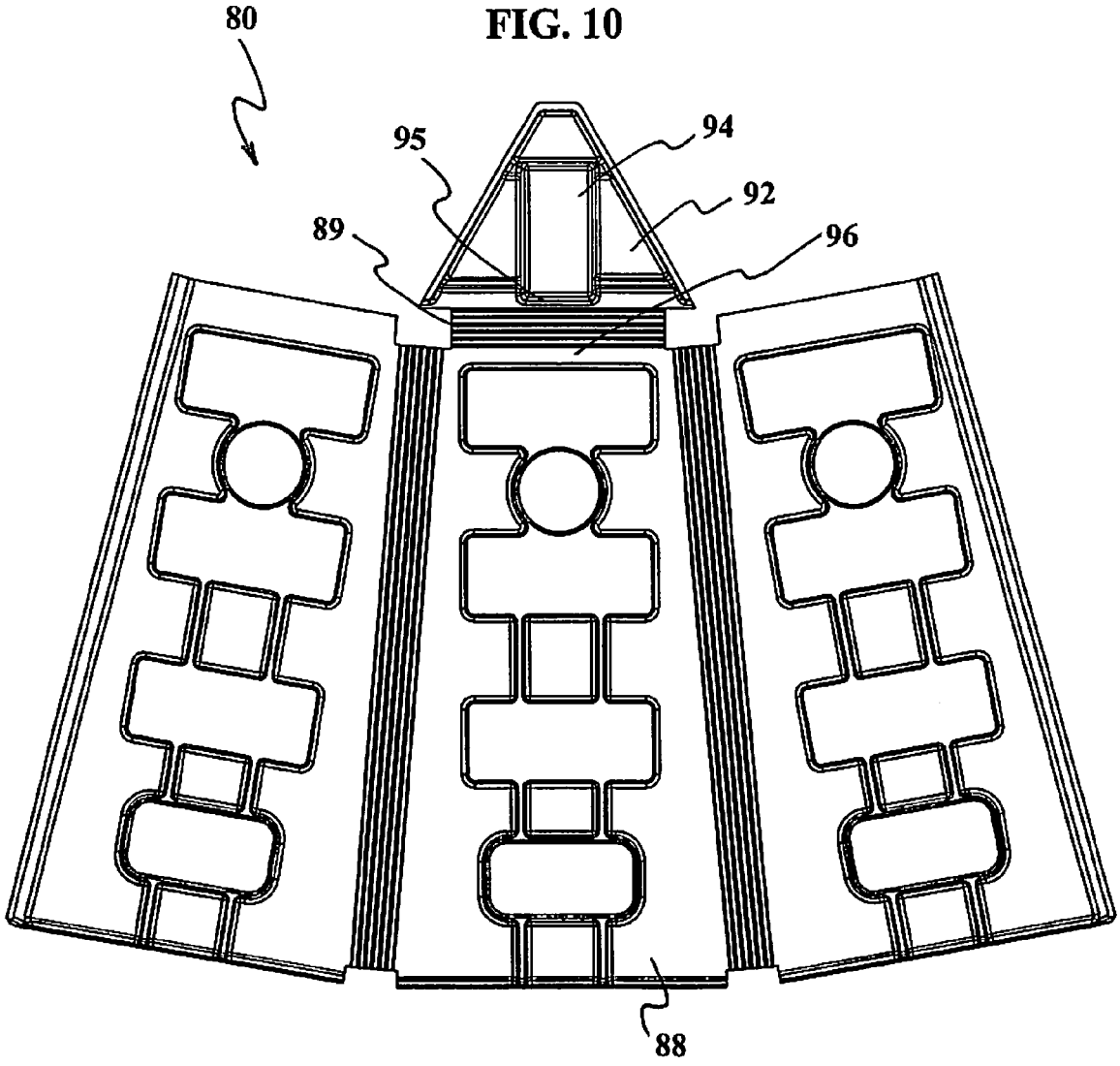
FIG. 10 is a top view of the collapsible construction barrier of FIG. 9 in a fully collapsed or flattened state, the collapsible construction barrier being adapted for receiving an emergency light when assembled.

FIG. 9 is a perspective view of an exemplary collapsible construction barrier 80 in a partially assembled state and having an emergency light 91. FIG. 10 is a top view of the collapsible construction barrier 80 in a fully collapsed or flattened state. Barrier 80 has a top shelf 92 formed with a recess 93 of a shape and size suited for snugly holding emergency light 91. Emergency light 91 may have a molded outer portion with a ridge (not shown) for allowing light 91 to be snapped into place and being held by a corresponding ridge (not shown) along a circumference of recess 93. Alternatively, a pin, lock or other securing/locking apparatus may be used for holding emergency light 91 in recess 93. By being secured in place, a chance of theft is reduced. Similarly, it may be advantageous to secure light 91 so that when barrier 80 is being assembled, separate labor is not required for installing light 91. Alternatively, emergency light 91 may be simply placed into recess 93 without being fixedly secured by any mechanism or separate device. In such a case, for example, recess 93 may be relatively deep, thereby providing a secure mounting space. Optionally, recess 93 may be formed as a "T" or as a "+," so that emergency light 91 may be oriented as desired by being turned in increments of ninety degrees.

An exterior part 94 of well 93 projects from a bottom surface of top shelf 92. Exterior part 94 has an end wall 95 that abuts a portion 96 of wall section 88 when construction barrier 80 is assembled, so that top shelf 92, including the added weight of emergency light 91, is further supported. Such prevents any excess loading of hinge section 89, portions of top shelf 92, and/or adjacent wall sections that are connected to top shelf 92. In addition, top shelf 92 has an expanded lip 98 that fits over the top edge 99 of the wall sections of barrier 80, for establishing a solid top surface and for holding wall sections 11, 12, 13 together. Expanded lip 98 may be attached to top edge(s) 99 using hook-and-loop fasteners and the like.

Connection of end walls 11, 13 to one another and to top shelf 92 may be made using break-away fasteners (not shown) so that if barrier 10 is hit by a passing automobile, barrier 10 breaks apart fairly easily. Such an application will naturally depend on various safety factors, and on a method of use. For example, outwardly-extending flanges 14 may be fastened to a road surface using stakes (not shown), ballast, and by other methods. Holes may be provided in outwardly-extending flanges 14 for such staking.

When barriers 10 are positioned very close to a high-speed lane of traffic, it may be desirable to accurately stake barrier 10 at a predetermined distance from a lane edge so barrier 10 remains at its fixed location. The "triangle" shape of barrier 10 allows barrier 10 to have one of its wall surfaces act as a planar surface in parallel with and in close proximity to the lane of traffic, compared with a conventional round barrel type barrier. In the event barrier 10 is hit by a car, it may be desirable for barrier 10 to unfurl completely and lie flat on a road surface. Similarly, it may be desirable to form outwardly-extending flanges 14 so that they bend to more readily allow such a flattened barrier, or so that flanges 14 break away from barrier 10 as the result of a large force shearing barrier 10 from its staked flanges. Alternatively, other applications may require strong outwardly-extending flanges 14 and, in such a case, gussets (not shown) may be provided as part of the structure of outwardly-extending flanges 14 to add structural integrity to flanges 14. In order for a barrier to unfurl completely when hit by an errant automobile, an exemplary embodiment of barrier 10 may be fastened together only by means of one or a few hook-and-loop fasteners disposed on inwardly-angled connection faces 41, 42, and/or by one or a few hook-and-loop fasteners located on an inner surface of expanded lip 98 together with top edge 99. A true break-away is thereby achieved. With any designed break away, there is a tradeoff between such a property and desired properties of structural integrity and strength, and resistance to break apart. Therefore, an optimal design may allow for use of different fastening systems for fastening edge portions 41, 42 to one another. For example, when a high resistance to break apart is desired, wire ties or similar break-resistant fasteners may be used. By comparison, when a low resistance to break apart is desired, a fastener that is easily broken when torqued may be used, a separate base structure (discussed below) may be used in place of fasteners, hook-and-loop fasteners may be used on selected edge portions of wall sections 11, 13 and top shelf 31, etc.

Another alternative embodiment includes a separate base structure (not shown) adapted for attaching or holding a barrier 10 thereto. For example, such a base structure may be adapted for slidingly receiving the outwardly-extending flanges 14 of an assembled barrier. The base structure, for example, may be staked to a road surface and a barrier 10 may be inserted into the base at a later time. In this manner, the base structures are not cumbersome, and a road worker can easily carry a stack of base structures, and a bag of stakes, for installation along a line parallel with a traffic lane. Thereby, the installation of barriers is quick and accurate, and may be achieved without the use of a separate truck for carrying traffic barrels, as was traditionally done. As a result, a row of barriers may be placed in tight spots without the need for blocking off a portion of a road to accommodate a barrier-carrying truck. Collapsible barriers 10 may be carried in a much more efficient manner compared with conventional traffic barrels, and may be assembled and put into place by being inserted into the base structures, by being transported in a folded, flattened, or edge-standing manner by a much smaller vehicle, by being carried by hand, by being tossed quickly from a truck in a flattened state and later assembled, etc. In addition, the two-piece barrier with base structure may be designed so that outwardly-extending flanges 14 of barrier 10 break away from the base structure when barrier 10 is hit by a vehicle, whereby barrier 10 unfurls and falls away from the vehicle. In such a case, barrier 10 may be easily put back into place if undamaged or replaced if damaged, and the base structure remains staked in its proper position. The unfurling may be assisted by elimination of fasteners otherwise used for attaching edge portions 41, 42 to one another. The use of the base structure, along with structural integrity provided when top shelf 31 is secured to wall sections 11, 13, holds edges 41, 42 together without the use of fasteners, thereby assisting the aforementioned unfurling.

Figure 11:
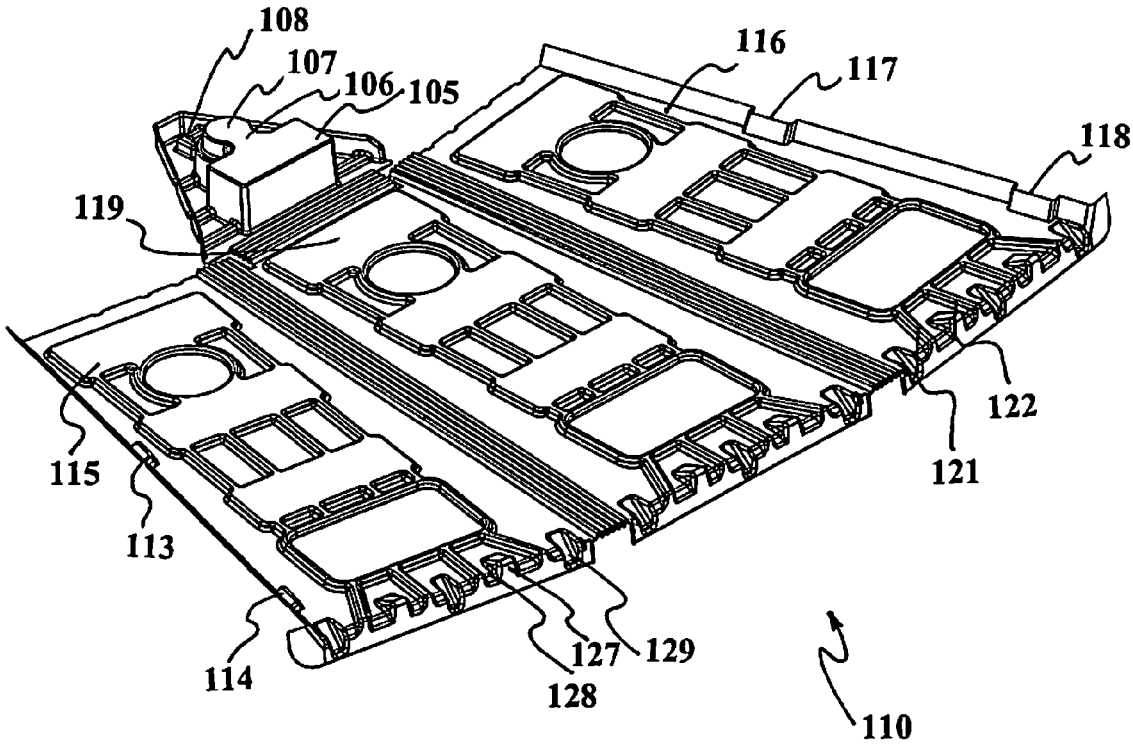
FIG. 11 is a perspective view of a collapsible construction barrier in a fully collapsed or flattened state, the collapsible construction barrier being adapted for receiving an emergency light, a beverage container and assorted other objects on its top shelf when assembled, according to an exemplary embodiment of the invention.
Figure 12:
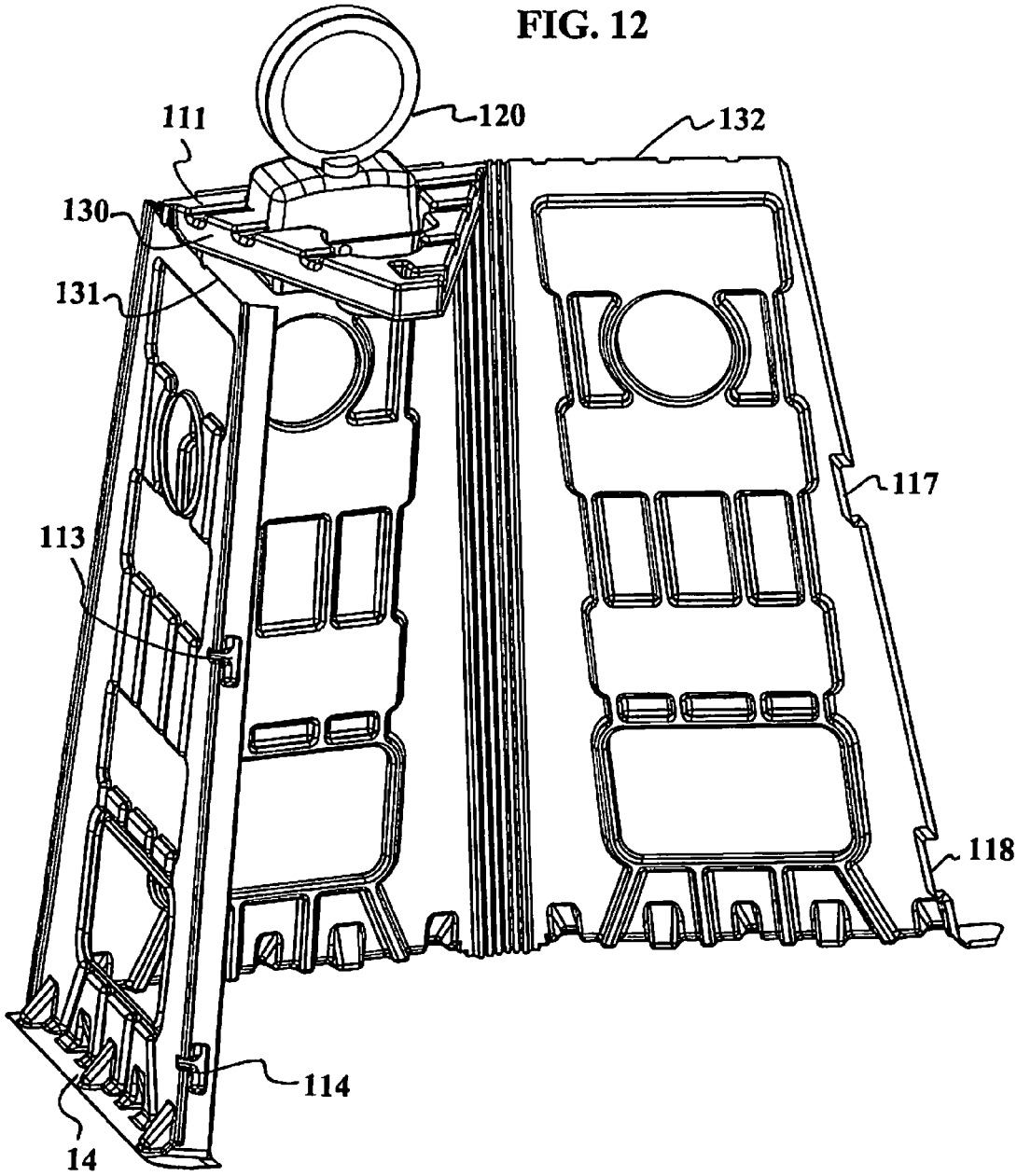
FIG. 12 is a perspective view of the collapsible construction barrier of FIG. 11 a partially assembled state and having an emergency light.
Figure 13B:
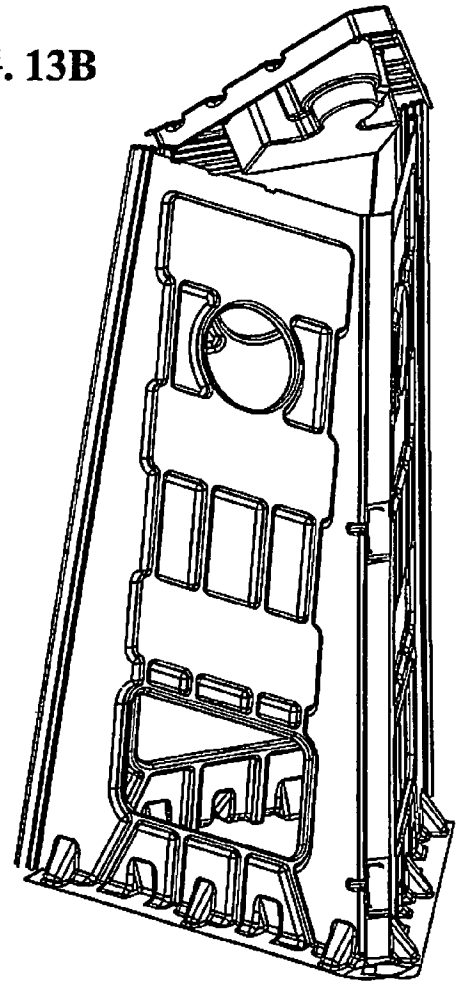
FIGS. 13A and 13B show the collapsible construction barrier of FIG. 11 in partially assembled states, where
Figure 13A:
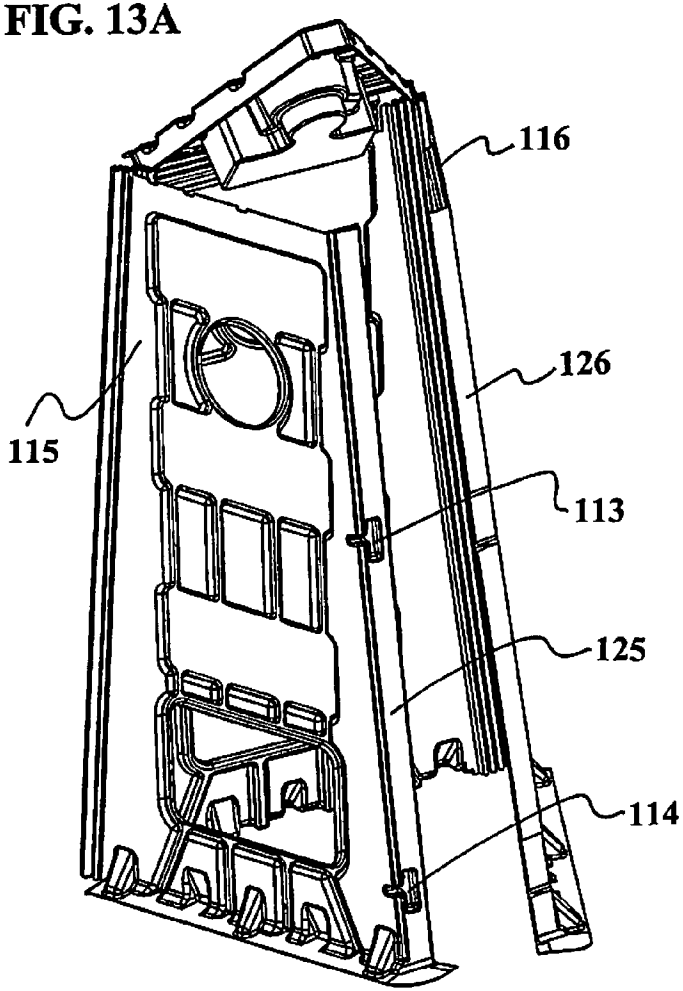

FIG. 11 is a perspective view of a collapsible construction barrier 110 in a fully collapsed or flattened state, according to a still further embodiment. FIG. 12 shows barrier 110 in a partially assembled state and having an emergency light 120 being held in a light compartment 105 formed in top shelf 111. FIGS. 13A and 13B show the collapsible construction barrier of FIG. 11 in partially assembled states, where FIG. 13A shows endmost wall sections being unjoined and FIG. 13B shows the endmost wall sections being joined to one another.

Top shelf 111 is adapted for receiving on its top shelf, when barrier 110 is assembled, an emergency light 120 in deeply recessed compartment 105, for receiving a beverage container in a multi-level, recessed drink holder area 107, for receiving and securely holding a walkie-talkie, a two-way radio commonly used by road crews and the like, or assorted other objects in a right-angled recess area 108, and for receiving miscellaneous items in area 106. Since road workers traditionally place some of these objects on top of a nearby traffic barrel, top shelf 111 improves over conventional structures not adapted for securely holding such objects. In addition, barrier 110 may include one or more accessory holders (not shown), for example a roll holder secured to an inner portion of barrier 110 and adapted for holding a roll of police tape used for cordoning-off an area including one or more barriers 110, a flag holder attached to or integrally formed with the barrier, etc.

Latch members 113, 114 are adapted for snugly fitting in notches 117, 118 of respective wall sections 115, 116 so that latch members 113, 114 snap into place and securely hold wall sections 115, 116 together by securing edge portion 126 to overlap edge portion 125. Latch members 113, 114 in the illustrated example, are "T" shaped and are connected to the exterior face of wall section 115, either integrally or by being attached. Latch members 113, 114 may be formed of any chosen material in order to provide a desired degree of fastening. For example, the previously-discussed break apart may be facilitated by use of latch members 113, 114 that become unfastened only when wall sections 115, 116 are torqued in a particular predetermined manner (e.g., in a range of angular displacement), when barrier 110 is hit by an errant vehicle. Alternatively latch members 113, 114 may be formed of a material (e.g., rubber) especially suited for bending and becoming unfastened from notches 117, 118 when a predetermined amount of force is applied. Various other known methods may be used for adapting barrier 110 for a controlled break apart and unfurling.

Top shelf 111 has an outer perimeter lip 130 that is adapted for snugly fitting over upper edges 131, 132 of respective wall sections 115, 116. A hook-and-loop fastener (not shown) may be provided to secure a portion of the inside of lip 130 to a portion of wall 115, wall 116, and/or edges 125, 126.

Gussets 127, 129 may be provided for strengthening the structural joinder of outwardly-extending flanges at the bottoms of wall sections 115, 116, 119. Gussets 127, 129 as shown are oriented to project inwardly or outwardly, and may be provided adjacent notch portions 128 of a chosen shape and size. For example, notch portions 128 may be separated by vertically oriented ribs 121, 122. When it is determined that a larger proportion of forces exerted on barrier 110 are transmitted to a bottom portion, gussets 127, 129 and associated structure may result in barrier 110 having a greater resistance to deformation.

Figures 14A, 14B, 14C, 14D:
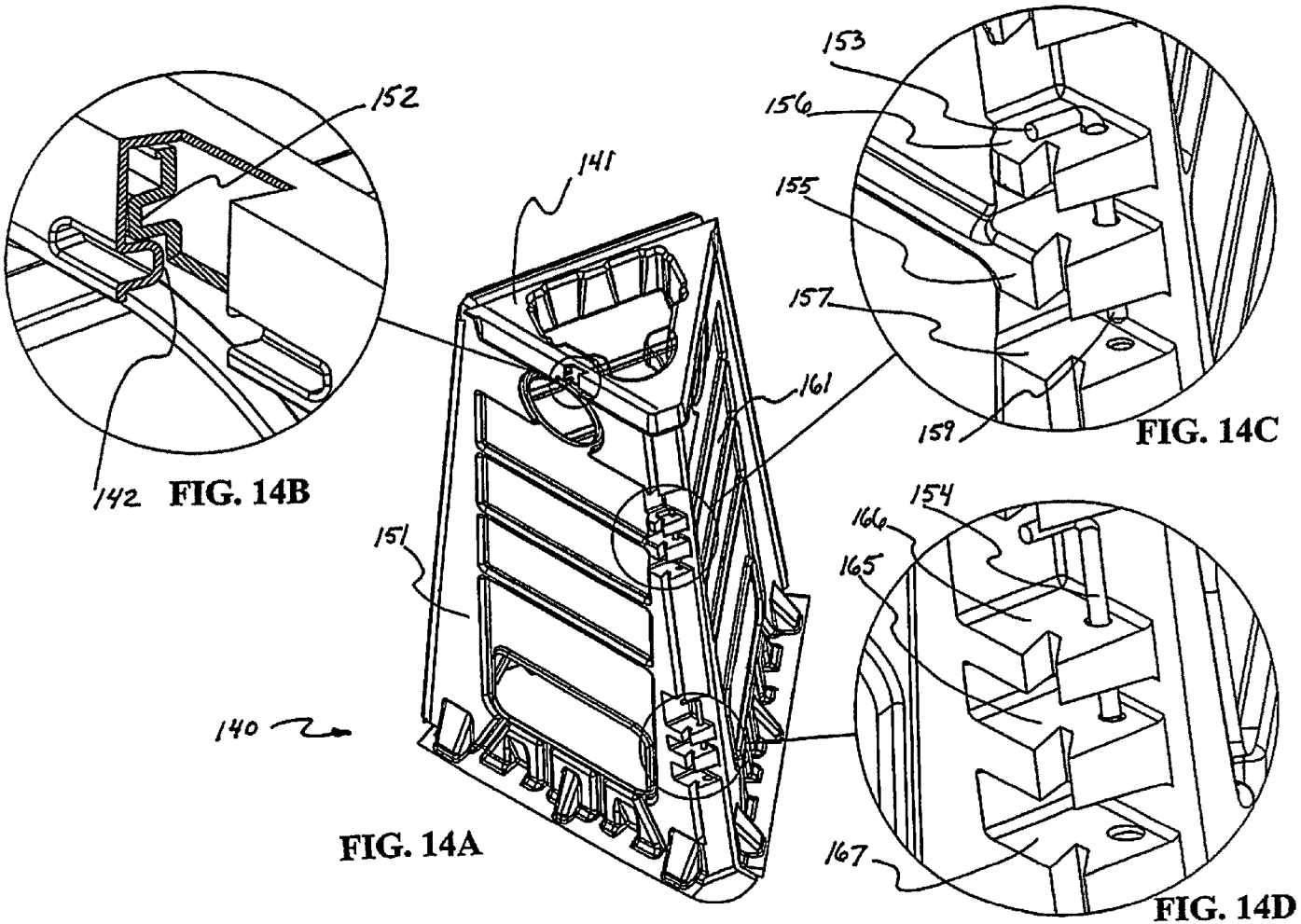
FIG. 14A is a perspective view of an erected collapsible barrier according to an embodiment of the invention.
FIGS. 14B-14D respectively show an enlarged cutaway view of a section of the barrier of FIG. 14A where a top section is securely held to wall sections by engagement of respective projecting portions of the top section and wall sections, an enlarged perspective view of a locking pin of the barrier of FIG. 14A in a closed position, and an enlarged perspective view of a locking pin of the barrier of FIG. 14A in an open position.

FIG. 14A is a perspective view of an erected collapsible construction barrier 140 according to an embodiment of the invention; FIGS. 14B-14D respectively show an enlarged cutaway view of a section of the barrier of FIG. 14A where a top section 141 is securely held to wall sections 151, 161 by engagement of respective projecting portions 142, 152 of top section 141 and wall sections 151, 161, an enlarged perspective view of a locking pin 153 of barrier 140 in a closed position, and an enlarged perspective view of a locking pin 154 of barrier 140 in an open position. From a collapsed state, erection is performed by joining wall section 151 to wall section 161, preferably with all wall sections in an upright position. Locking bosses (not shown) of wall section 161 are formed with a same shape and a smaller size compared with center pin guides 155, 165. Such locking bosses fit into respective center pin guides 155, 165 and each have holes that are aligned with holes in respective pin guides 155, 165 so that respective pins 153, 154 pass through the locking bosses and thereby securely attach wall sections 151, 161 to one another. For illustration purposes, pin 153 of FIG. 14C is shown in a closed position where the distal end 159 of pin 153 extends through center pin guide 155, whereas pin 154 of FIG. 14D is shown with its distal end adjacent the upper hole of center pin guide 165. Such a position of FIG. 14D allows the corresponding locking boss of wall section 161 to be removed from its engagement with center pin guide 165. The top section 141 is shown secured to wall sections by engagement of protruding portion(s) 142 of top section 141 with corresponding protruding portions 152 formed along the topmost side of each side wall 151, 161. Top section 141 may be so secured by simply pushing down on it or hitting it so that protruding portions 142 are moved from the top to the bottom side of protrusions 152. The relative positions of protrusions 142, 152 are then such that they frictionally engage one another with a slight tension so that top section 141 is held in a fitted and snug manner. Thereby, top section 141 is secured to wall sections 151, 161 without any need for fasteners and is put in place, for example, with a single slapping motion of an erector's hand.

Figures 15A, 15B:
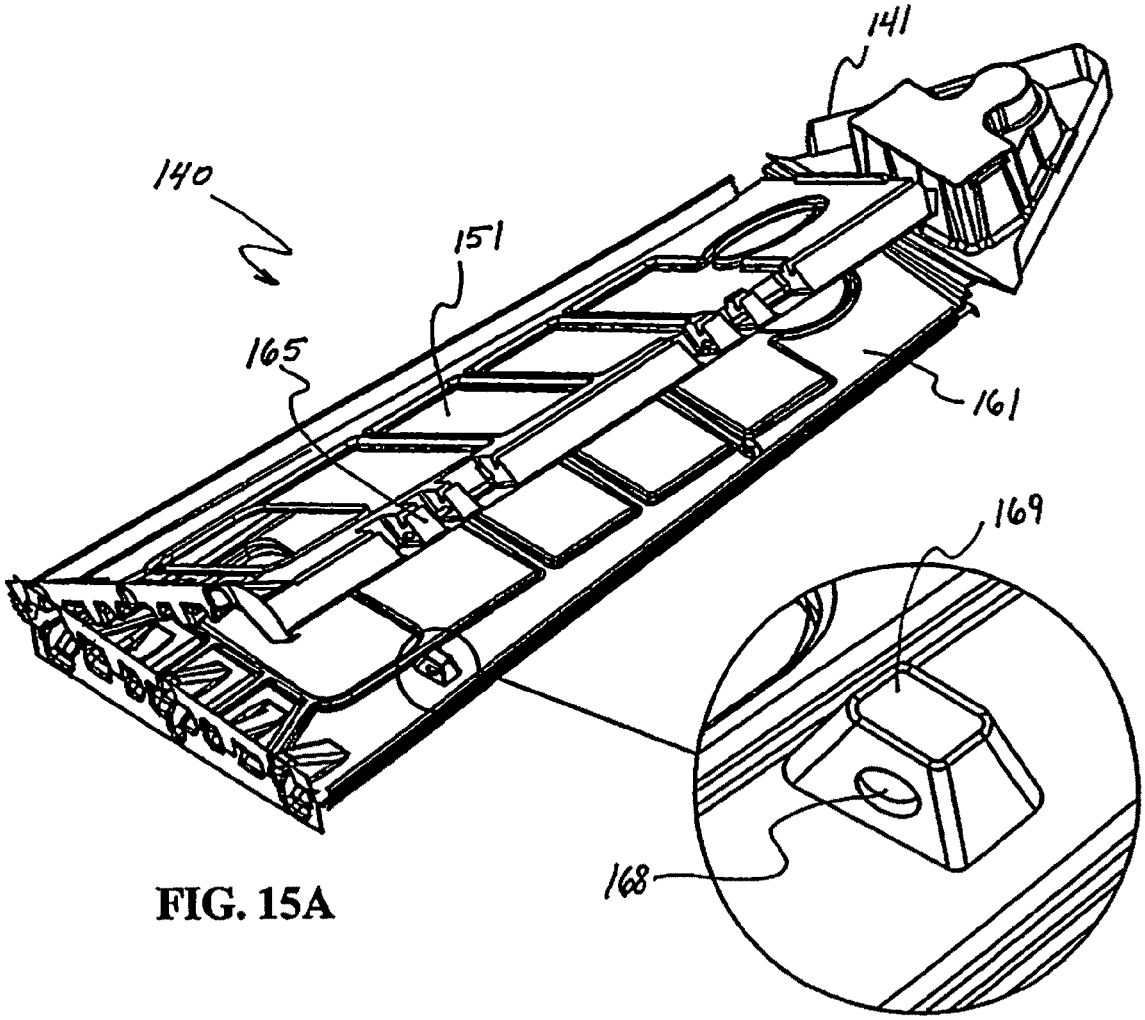
FIG. 15A is a perspective view of the collapsible barrier of FIG. 14A in a collapsed and folded state.
FIG. 15B is an enlarged perspective view of a keeper boss formed in a wall section of the collapsible construction barrier at a location for engaging the locking pin portion of another wall section.
Figures 16A, 16B:
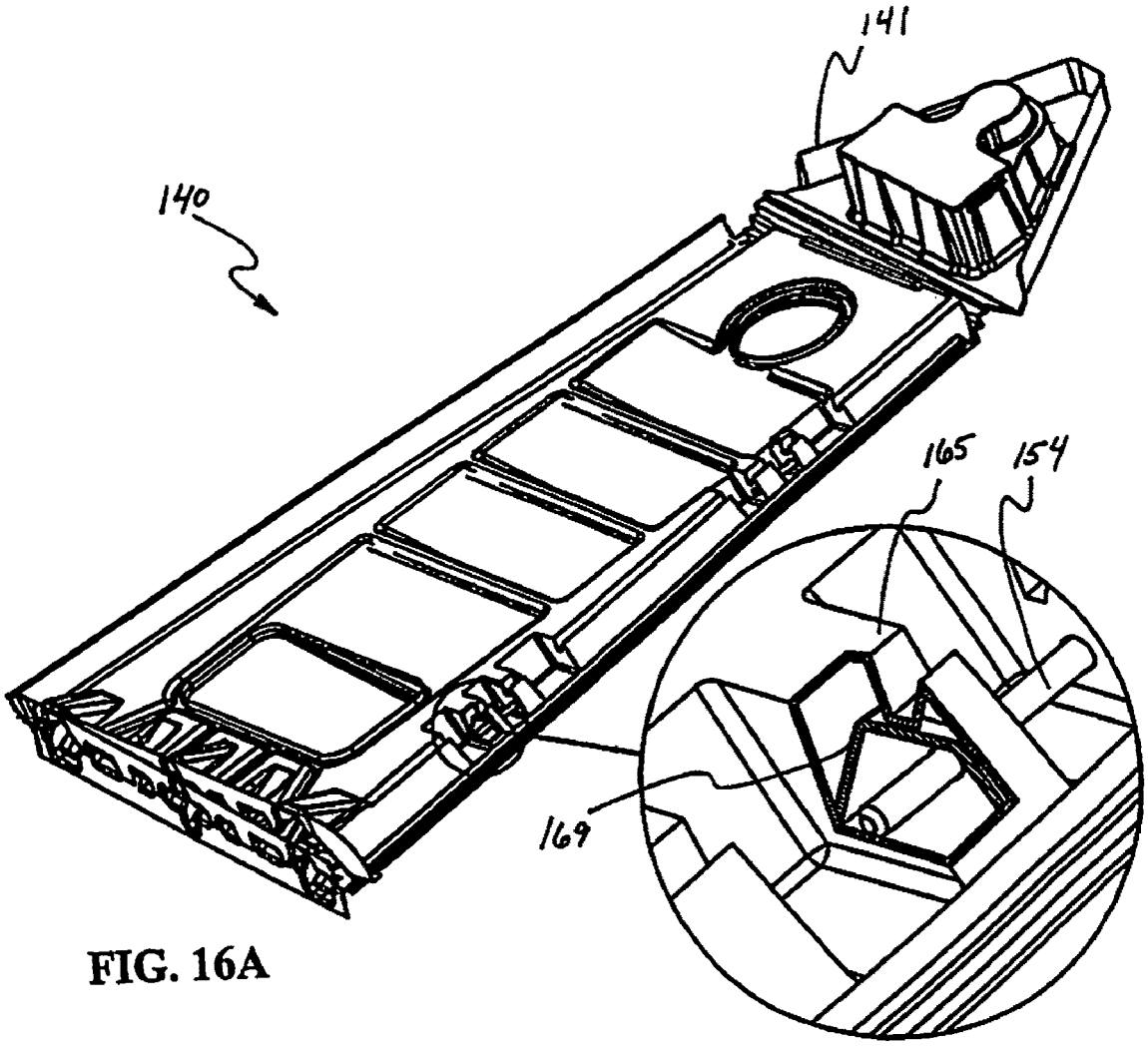
FIG. 16A is a perspective view of the collapsible barrier of FIG. 14A in a collapsed state and locked into a folded position having a footprint of a single wall section.
FIG. 16B is an enlarged cutaway view of a portion of FIG. 16A showing a keeper boss of one wall section adapted for receiving the locking pin and engaging with the pin guide of another wall section of the collapsible barrier.

FIG. 15A is a perspective view of collapsible construction barrier 140 in a collapsed and folded state; FIG. 15B is an enlarged perspective view of a keeper boss 169 formed in wall section 161 of collapsible construction barrier 140 at a location for engaging the locking pin portion of wall section 151. Specifically, keeper boss 169 is a same shape and a smaller size compared with center pin guide 165, and has holes 168 that are aligned with corresponding holes in center pin guide 165 when wall section 151 is folded against wall section 161. As shown in FIG. 16A, locking pin 154 may then be inserted into keeper boss 169, thereby securing collapsible construction barrier 140 in a collapsed state and locked into a folded position having a footprint of a single wall section. FIG. 16B is an enlarged cutaway view of a portion of FIG. 16A showing the structure of keeper boss 169 of wall section 161. In addition, top section 141 may be folded back to essentially be within the footprint of the folded barrier 140, for example for shipping barrier 140 in a shipping box having a footprint approximating one of the wall sections.

While the principles of the invention have been shown and described in connection with specific embodiments, it is to be understood that such embodiments are by way of example and are not limiting. The foregoing description of the present invention has been presented for purposes of illustration and description. Such description is not intended to limit the invention to the form disclosed herein. Consequently, variations and modifications commensurate with the above teachings, and commensurate with the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

We claim:

1. A collapsible barrier comprising at least three integrally-formed wall sections with a plurality of contiguous living hinges, as a series, joining each adjacent pair of wall sections, endmost wall sections of the at least three wall sections being joinable to form an upright structure.

2. The collapsible barrier of claim 1 further comprising a first top section formed integrally with and joined to one of the wall sections by a top hinge member that includes a plurality of living hinges formed as a series.

3. The collapsible barrier of claim 2 wherein:

the at least three integrally-formed wall sections include first and a second endmost wall sections adapted to be joined to one another for erecting the collapsible barrier, the first and second endmost wall sections each having an outward-facing wall with a top side and a projecting portion on the respective outward-facing wall adjacent the respective top side; and the first top section having perimeter sides which include first and second sidewalls each approximately orthogonal to the top surface, each of the first and second sidewalls having an inward-facing wall with a projecting portion, whereby when the first and second endmost wall sections are joined to one another, an urging of the first top section downwardly onto the first and second endmost wall sections causes the projecting portions of the first and second sidewalls to engage respective ones of the projecting portions of the first and second endmost wall sections, thereby securing the first top section to the wall sections.

4. The collapsible barrier of claim 2 wherein the wall sections and the first top section are adapted to be interlocked with one another for erecting the collapsible barrier.

5. The collapsible barrier of claim 2 further comprising a second top section formed integrally with the first top section, wherein the second top section is adapted for being part of the top surface of the collapsible barrier.

6. The collapsible barrier of claim 1 further comprising joining means for attaching endmost ones of the three wall sections.

7. The collapsible barrier of claim 6 wherein the joining means include at least one of a zip tie, a hook and loop connector, a clasp, a latch, a snap connector, a pin, and a locking connector.

8. The collapsible barrier of claim 6 wherein the joining means is not integrally formed with the wall sections or top section.

9. The collapsible barrier of claim 1 formed as a single sheet of thermoformable polymer.

10. The collapsible barrier of claim 1 wherein the three wall sections each has an essentially rectangular hole formed therein.

11. The collapsible barrier of claim 10 wherein the rectangular holes are each adapted for passing a boardlike member therethrough.

12. The collapsible barrier of claim 10 wherein the three wall sections are foldable one on another, and wherein, when the barrier is thereby folded, the rectangular holes are aligned with one another.

13. The collapsible barrier of claim 1 wherein the three wall sections each has an essentially round hole formed therein.

14. The collapsible barrier of claim 13 wherein the three wall sections are foldable one on another, and wherein, when the barrier is thereby folded, the round holes are aligned with one another.

15. The collapsible barrier of claim 13 wherein the round holes are each adapted for passing a pipelike member therethrough.

16. The collapsible barrier of claim 1 wherein the at least three wall sections are foldable one on another whereby the folded collapsible barrier has a footprint approximating that of one of the wall sections.

17. A thermoformed collapsible barrier comprising:

at least three wall sections, each wall section having a top edge, two longitudinal sides; and at least one wall hinge member connecting adjacent interior ones of the wall sections' longitudinal sides, each such wall hinge member comprising a plurality of living hinges interconnected as a series to form an upright structure.

18. The thermoformed collapsible barrier of claim 17 further comprising:

a top section having a number of perimeter sides corresponding to the number of wall sections in the plurality of wall sections;

a top hinge member connecting one of the perimeter sides of the top surface to one of the plurality of top edges, the top hinge member comprising a plurality of interconnected living hinges.

19. The thermoformed collapsible barrier of claim 17 wherein the series of interconnected living hinges includes a longitudinal rib between adjacent ones of the living hinges, the adjacent living hinges each having respective radial curvatures, and wherein a ratio of a lateral width of the rib to at least one of the radial curvatures is based on a desired transfer of bending force between the adjacent living hinges.

20. A thermoformed collapsible barrier comprising:

at least three wall sections;

at least one hinge member connecting adjacent interior ones of the wall sections' longitudinal sides to form an upright structure, the hinge member comprising a plurality of interconnected living hinges, wherein a nominal thickness of the at least one hinge member of the thermoformed collapsible barrier approximates 0.100 inch.

21. A method of providing a collapsible barrier having at least one elongate rib separating adjacent ones of a plurality of living hinges, the plurality of living hinges connecting two wall sections, the method comprising:

determining a range of travel for the plurality of living hinges;

determining a desired force distribution profile for the range of travel; and implementing the desired force distribution profile for the plurality of living hinges by selecting a ratio of a width of the elongate rib to a minimum thickness of the adjacent ones of a plurality of living hinges.

* * * * *